United States Patent [19]

Barnes et al.

[11] Patent Number: 4,585,737

[45] Date of Patent: Apr. 29, 1986

[54] PREPARATION OF OXYGENATED AMBROXIDES

[75] Inventors: Adrian G. Barnes; Peter C. Bevan, both of Southampton, England

[73] Assignee: British-American Tobacco Company Limited, London, England

[21] Appl. No.: 665,763

[22] Filed: Oct. 29, 1984

[30] Foreign Application Priority Data

Nov. 3, 1983 [GB] United Kingdom ..... 8329412

[51] Int. Cl.[4] ..... C12P 17/04

[52] U.S. Cl. ..... 435/126; 131/277; 549/458

[58] Field of Search ..... 549/458; 435/126; 131/277

[56] References Cited

U.S. PATENT DOCUMENTS

| | | | |
|---|---|---|---|
| 2,905,575 | 9/1959 | Giles | 131/277 |
| 2,905,576 | 9/1959 | Schumacher | 131/277 |
| 2,978,365 | 4/1961 | Schumacher | 131/277 |

OTHER PUBLICATIONS

Cambie et al., Australian J. Chem vol. 23, pp. 1439–1455, (1974).

*Primary Examiner*—Henry R. Jiles
*Assistant Examiner*—Bernard I. Dentz
*Attorney, Agent, or Firm*—Kane, Dalsimer, Kane, Sullivan and Kurucz

[57] ABSTRACT

In a method for the production of an agent for modifying a smoke-flavor, ambroxide is contacted with a microbial culture to effect a transformation of at least a proportion of the ambroxide to a product comprising at least one oxygenated derivative of ambroxide. The said product may comprise at least one of the compounds A, B and C, each as defined in the specification. The respective Compound, (particularly Compound A), may be extracted from said product for incorporation with a smoking material. Thus a smoke-flavor modifying agent produced by the aforesaid method for incorporation with, or included in, a smoking material or smoking article may comprise at least one compound of the aforesaid group.

The loading level of the said agent may be within a range of 0.1 to 100 parts per million or, suitably, of 0.5 to 10 parts per million, of the said smoking material.

4 Claims, No Drawings

PREPARATION OF OXYGENATED AMBROXIDES

This invention relates to smoke-flavour modifying agents and a method of production thereof.

Flavour-modifying agents provide an additional tool for the assistance of the tobacco blender whereby control for the attainment of a desired smoke-flavour can be exercised more reliably and/or with greater economy.

Ambroxide is a compound known for its use in flavouring and perfumery. Its full chemical name is: dodecahydro-3a,6,6,9a-tetramethylnaptho (2,1-b) furan and it is available in commerce. As used in the present invention, it was obtained from Firmenich et Cie, Geneva, Switzerland under the trade name Ambrox. This material was further purified by chromatography prior to use.

According to the present invention there is provided a method for the production of a smoke-flavour modifying agent, wherein ambroxide is contacted with a microbial culture to effect a transformation of at least a proportion of the ambroxide to a product comprising at least one oxygenated derivative of ambroxide. The product may comprise at least one compound of the group consisting of Compound A, Compound B and Compound C, each of which compounds is as respectively defined (hereinbelow).

Also according to the invention, a smoke-flavour modifying agent for incorporation with a smoking material comprises one or more compounds from the said group consisting of Compound A, Compound B and Compound C.

A product comprising Compounds A, B and C may be used as a tobacoo-smoke flavour-modifying agent. Alternatively, one or more of the compounds, advantageously being or including the more effective Compound A, may be first extracted and the extracted compound or compounds used as tobacco-smoke flavour-modifying agent or agents.

The smoking material may be tobacco, a reconstituted smoking-tobacco material or a tobacco substitute material. The agent may be incorporated with a smoking material by being sprayed thereon in a volatile solvent. The agent is suitably added to the smoking material at a loading level within a range of 0.1 to 100 parts per million of smoking material, but preferably in a range of 0.5 to 10 parts per million.

The chemical structure of Compound A, may be represented as:

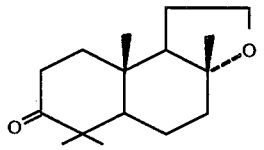

The chemical structure of Compound B may be represented as:

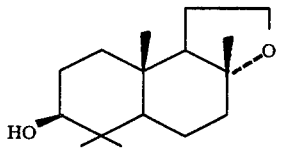

The chemical structure of Compound C may be represented as:

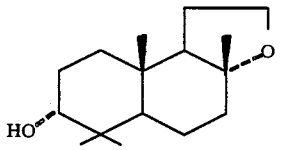

We have discovered that a wide range of micro-organisms may be used in the transformation of ambroxide to products comprising 3-keto-ambroxide (Compound A), 3β-hydroxy-ambroxide (Compound B) and 3α hydroxy-ambroxide (Compound C). Of thirty-two fungal shake-flask cultures it was found that fourteen were effective in transforming ambroxide to give Compounds A, B and C, although considerable variations in extent of conversion were found. With a further four of the thirty-two fungi, Compound B and Compound C only were found to be present. The eighteen fungi were identified as species of Aspergillus (5 strains) Penicillium (2 strains), Cladosporium (2 strains), Ophiobolus (1 strain), Alternaria (1 strain), Beauveria (1 strain), Rhizopus (1 strain) and Phoma (1 strain). The remaining four fungi could not be identified due to lack of sporulation. Examples of suitable fungi are:

| | |
|---|---|
| *Cladosporium oxysporum* | CBS 548.80 |
| *Ophiobolus herpotrichus* | CBS 240.31 |

The above-named fungi are obtainable from the Centraalbureau Voor Schimmelcultures, Oosterstraat 1, Baarn, Holland. The culture deposit having the accession number CBS 548.80 was made with the Centraalbureau Voor Schimmelcultures on 25th May, 1980 and characteristics of it are given in United Kingdom Patent Specification No. 2,093,446A, to which reference is directed.

In addition, six known strains of actinomycetes of the genus Streptomyces were screened in a similar manner. Two of the six, also available from the Centraalbureau Voor Schimmelcultures, were identified as producing the Compounds A, B and C from ambroxide. These two strains were:

| | |
|---|---|
| *Streptomyces olivaceoviridis* | CBS 888.69 |
| *Streptomyces roseochromogenes* | CBS 952.69 |

The selection of micro-organisms which possess the property of transforming ambroxide to yield Compounds A, B or C was made by incubating ambroxide with a range of micro-organisms obtained from culture collections and by direct isolation from natural substances such as soil and tobacco leaves. The novel compounds were identified by comparing extracts from the culture media with controls comprising culture media having no ambroxide and culture media inoculated with ambroxide but without inoculation of the micro-organism. The compounds were then isolated and purified and predetermined proportions thereof were incorporated with cigarette tobacco.

Cigarettes filled with this tobacco were smoked by an expert panel of smokers to assess the effect of respective products on the tobacco smoke. In all cases, smokers noted an appreciable effect upon the flavour of the smoke, but without the intrusion of any undesirable smoke attribute.

The following examples illustrate procedures for obtaining the ambroxide derived compounds.

EXAMPLE 1

A pure culture of Cladosporium oxysporum (CBS 548.80) was inoculated into two 250 ml Erlenmeyer flasks each containing 100 ml sterile malt extract broth of formula:

| | |
|---|---|
| Malt extract | 17 g |
| Mycological peptone | 3 g |
| Distilled water | 1000 ml |
| pH | 5.4 |

The flasks were incubated on an orbital shaker at room temperature, with a shaker speed of 150 rpm, for four days in order to obtain a growth of C. oxysporum. 100 mg of ambroxide, dissolved in polyoxyethylene sorbitan monooleate, supplied by Sigma Chemicals, Poole, England, under the trade name "Tween 80", was then added to one of the two flasks and in equal quantity to a third flask containing 100 ml of the sterile malt extract, but no fungus. Incubation of all three flasks was continued for a further seven days after which the content of each flask was extracted with 1,1,1-trichloroethane. After concentration, the extracted products from the three flasks were compared with each other by means of thin layer chromatography (TLC), using silica gel plates and a 95:5 chloroform/methanol solvent. For visualisation purposes, the plate were sprayed with a mixture of anisaldehyde and sulphuric acid in ethanol and then heated. In the case of the product from the flask in which ambroxide was added to the fungal culture, the TLC procedure indicated the presence in significant amounts of three substances additional to ambroxide. These substances were not present in the extracts from the other two flasks. It was concluded that the three additional substances had resulted from a transformation of the ambroxide brought about by the C. oxysporum fungus. The three additional substances produced were all more polar than ambroxide by Rf value in the TLC system:

| | |
|---|---|
| Substance I | Rf 0.63 |
| Substance II | Rf 0.47 |
| Substance III | Rf 0.42 |
| Ambroxide | Rf 0.67 |

Substances I, II and III were separated by a combination of column and high pressure liquid chromatography. Each was then identified using gas chromatography—mass spectrometry, nuclear magnetic resonance and infra-red analysis. The following identities were established:

| | |
|---|---|
| Substance I | 3-ketoambroxide |
| Substance II | 3β-hydroxyambroxide |
| Substance III | 3α-hydroxyambroxide |

Substance I is Compound A, Substance II is Compound B and Substance III is Compound C.

EXAMPLE 2

2.5 l of sterile malt extract broth in a 3 l fermenter vessel was inoculated with *Ophiobolus herpotrichus* (CBS 240.31) and incubated at 25° C. with continuous stirring and aeration. After 24 hours, 2.5 g of ambroxide dissolved in Tween 80 was added. The incubation was then continued for a further 96 hours with samples taken at 24 hour intervals. Analysis of these samples showed the ambroxide gradually disappeared over the incubation period and that Compounds A, B and C gradually appeared.

EXAMPLE 3

The general procedure of Example 2 was followed but a 20 l vessel containing 10 l of sterile malt extract broth was used with C. oxysporum in place of O. herpotrichus. 10 g of ambroxide in 80 ml of Tween 80 was added and the broth stirred at 800 rpm and aerated at 6.0 l/min. 3.07 g of mixed products comprised of Compounds A, B and C were identified in the broth after 45 hours incubation. The relative yields were, Compound A 620 mg; Compound B 2100 mg; Compound C 350 mg.

EXAMPLE 4

As Example 1, but using a pure culture of O. herpotrichus (CBS 240.31) instead of C. oxysporum. At the conclusion of the seven days incubation period the Compounds A, B and C were found to be present.

EXAMPLE 5

As in Example 1, but using a medium of the following formulation:

| | |
|---|---|
| Cornsteep liquor | 6 g |
| $KH_2PO_4$ | 3 g |
| $CaCO_3$ | 3.5 g |
| Peptone | 5 g |
| Yeast extract | 2.5 g |
| Glucose | 10 g |
| Distilled water | 1000 ml |
| pH | 7.0 |

and using a pure culture of Streptomyces olivaceoviridis (CBS 888.69). At the conclusion of seven days incubation, Compounds A, B and C were found to be present.

For the purpose of assessing the smoke-modifying properties of each of the Compounds A, B and C, an assessment panel smoked cigarettes having a filler of flue-cured tobacco and cigarettes having American-style blended tobacco fillers to each of which one of the Compounds A–C had been added. The effect of each compound on the tobacco smoke was assessed against control cigarettes containing no added smoke-modifying agent. Each of the cigarettes was of 9 mg total particulate matter delivery. The Compounds A–C were each added to the test cigarettes, by syringe, in the form of a solution in ethanol, the resultant loading level being 1.0 ppm for Compound A and 10 ppm for Compound B and Compound C. The control cigarettes had introduced into them the same quantity of ethanol but with nothing dissolved therein. Both the test and the control cigarettes were put aside for 48 hours before being smoked by the panel.

Compounds A, B and C were found to modify the tobacco smoke flavour considerably by contributing sweet, floral, musk-like and cedar-like notes to it, and also by increasing the perceived body of the smoke. While Compounds A, B and C were effective on both flue-cured and blended cigarettes, they were judged to be particularly compatible with the latter.

We claim:

1. A method for the preparation of an oxygenated ambroxide selected from the group consisting of 3-keto-ambroxide, 3-$\beta$-hydroxy-ambroxide and 3-$\alpha$-hydroxyambroxide, which comprises; the biotransformation of ambroxide with a microbial culture selected from the group consisting of ambroxide oxygenating fungi and ambroxide oxygenating Streptomyces.

2. A method according to claim 1 wherein the oxygenated ambroxide selected is 3-keto-ambroxide.

3. The method of claim 1 wherein the culture selected is a fungi and said fungi is selected from the group consisting of *Cladosporium oxysporum* and *Ophiobolus herpotrichus.*

4. The method of claim 1 wherein the culture selected is a Streptomyces and said Streptomyces is selected from the group consisting of Streptomyces olivaceoviridis and Streptomyces roseochromogenes.

* * * * *